United States Patent [19]

Sorenson

[11] 4,437,570

[45] Mar. 20, 1984

[54] SHIPPING CARTON WITH CASE KNIFE PROTECTION FOR INNER CARTONS

[75] Inventor: John F. Sorenson, St. Paul, Minn.

[73] Assignee: Champion International Corporation, Stamford, Conn.

[21] Appl. No.: 398,678

[22] Filed: Jul. 15, 1982

[51] Int. Cl.[3] ..... B65D 65/26

[52] U.S. Cl. ..... 206/601; 206/499; 206/526; 229/8; 229/37 R

[58] Field of Search ..... 206/601, 602, 603, 44 R, 206/526, 499; 30/2; 229/8, 37 R, 38, 39 R, DIG. 11, 40, 31 R

[56] References Cited

U.S. PATENT DOCUMENTS

| | | | |
|---|---|---|---|
| 359,435 | 3/1887 | Elliott | 229/37 R |
| 2,132,958 | 10/1938 | Martin | 206/601 X |
| 2,210,302 | 8/1940 | Petter | 229/37 R |
| 2,415,869 | 2/1947 | Coleman | 229/38 X |
| 2,669,351 | 2/1954 | Carson et al. | 229/37 R |
| 2,966,293 | 12/1960 | Goldsholl | 229/8 X |
| 3,002,672 | 10/1961 | Kotowick | 229/37 R |
| 3,078,989 | 2/1963 | Curran et al. | 229/8 X |
| 3,127,991 | 4/1964 | Burnett | 206/44 R |
| 3,394,866 | 7/1968 | Silver | 229/37 R |
| 3,412,924 | 11/1968 | Krzyzanowski | 206/602 |
| 3,485,435 | 12/1969 | Greene et al. | 229/40 |
| 3,693,865 | 9/1972 | Desmond et al. | 206/601 X |
| 3,927,823 | 12/1975 | Persson | 229/31 R |

FOREIGN PATENT DOCUMENTS

| | | | |
|---|---|---|---|
| 800860 | 12/1968 | Canada | 229/37 R |
| 1576115 | 6/1969 | France | 229/37 R |

*Primary Examiner*—William Price
*Assistant Examiner*—Gary E. Elkins
*Attorney, Agent, or Firm*—Evelyn M. Sommer; William W. Jones

[57] ABSTRACT

A shipping carton which contains other product cartons is designed so that it can be cut open with a knife without exposing the contained product cartons to damage by the knife. At least one side wall of the shipping carton is inwardly bowed so that the inner product cartons will be shifted away from the edges of the bowed side wall thereby leaving an internal void adjacent to the edges of the bowed side wall. A knife can be inserted through the edges of the bowed side wall into the void to cut the shipping carton without cutting the inner product cartons.

6 Claims, 11 Drawing Figures

SHIPPING CARTON WITH CASE KNIFE PROTECTION FOR INNER CARTONS

This invention relates to an improved carton, and more particularly to an improved corrugated paperboard shipping carton in which other product-containing cartons are packaged for shipment and storage.

Most products sold at the retail level in paperboard cartons, such as cake mixes, cereals, and other similar products, are shipped in bulk and stored in larger corrugated paperboard shipping cartons. The quickest and easiest way to remove the product cartons from the shipping cartons is to cut one panel off of the shipping carton with a knife to expose the product cartons. While this procedure is quick and easy, there is a substantial risk that the knife will also cut one or more of the product cartons in the shipping carton. Such an occurrence would,, of course, render the product in this cut product carton unsaleable.

The above-noted carton damage problem is a major problem which has provoked a number of solutions. In order to ensure that the inner cartons will not be touched by the case knife used to open the shipping carton, the use of spacers inside shipping cartons has been suggested, which spacers would separate the inner cartons from the shipping carton thus allowing the knife to enter the interior of the shipping carton without touching the inner cartons. This solution, however, requires that extra material, in the form of spacers be added to the package and properly positioned in the shipping carton, with additional time and money being expended. To date, the solutions offered for this problem have generally proven less than ideal since they all require extra material, or special carton forming equipment in order to be effective.

This invention relates to an improved shipping carton which can be erected with conventional carton erecting machinery, and which provides for positive displacement of the inner cartons away from portions of the shipping carton so that these portions can be cut with a knife to open the shipping carton without damaging the inner cartons. The carton is of the type having opposed pairs of major and minor side walls and pairs of major and minor end closure flaps foldably connected to opposite end edges of the major and minor side walls respectively. The carton of this invention is formed with at least one bowed side wall with the central portion of that side wall being bowed inwardly. The inward bowing of the side wall causes the product cartons in the shipping carton to be offset from the side edges of the bowed side wall which are connected to the adjacent side walls. This leaves a free space or void in the shipping carton at the fold connections between the bowed side wall and the adjacent side walls into which space a knife blade can be inserted without touching the product cartons contained in the shipping carton. Preferably each one of a pair of opposite side walls are thus bowed inwardly. The inward bowing is caused by forming the fold lines connecting the end closure flaps to the bowed side wall or walls as curved or skew fold lines. In either case, the medial portion of the curved or skew fold lines is closer to the free edges of the end closure flap than the ends of the fold lines. To accentuate the bowing, a medial fold line is formed in the bowed side wall extending from one end to the other thereof. The curved or skew fold lines also cause a reverse bowing of the end closure flaps so that their side edges bow inwardly against the inner product cartons causing further deflection thereof away from the inner surface of the shipping carton. The fold lines connecting the end closure flaps to the non-bowed side walls are aligned with the central portion of the adjacent curved or skew fold lines to provide flat stacking end surfaces for the shipping carton. The non-bowed closure flaps form the outermost portion of the end closure and serve to house and protect the bowed closure flaps, as well as form a flat stacking end surface. To open the shipping carton, a cut is made at the edge of one of the bowed panels all the way around the carton so that one of the non-bowed panels is actually cut off of the carton.

It is, therefore, an object of this invention to provide an improved corrugated paperboard shipping carton which can be cut open with minimum chance of accidentally cutting product cartons which are contained in the shipping carton.

It is a further object of this invention to provide a shipping carton of the character described wherein one or more of the side walls of the carton are medially inwardly bowed to offset the internal product cartons from the edges of the bowed side wall or walls.

It is an additional object of this invention to provide a shipping carton of the character described wherein a pair of end closure flaps foldably connected to each bowed side wall of the carton are provided with inwardly deflected side edges to offset the internal product cartons from the folded edge of an overlying closure flap.

It is another objet of this invention to provide a shipping carton of the character described wherein the bowing of the side walls and end closure flaps is produced by bowed fold connections between the bowed side walls and bowed end closure flaps.

These and other objects and advantages of this invention will become more readily apparent from the following detailed description of several preferred embodiments of shipping cartons formed in accordance therewith, when taken in conjunction with the accompanying drawings, in which.

Figure 1:
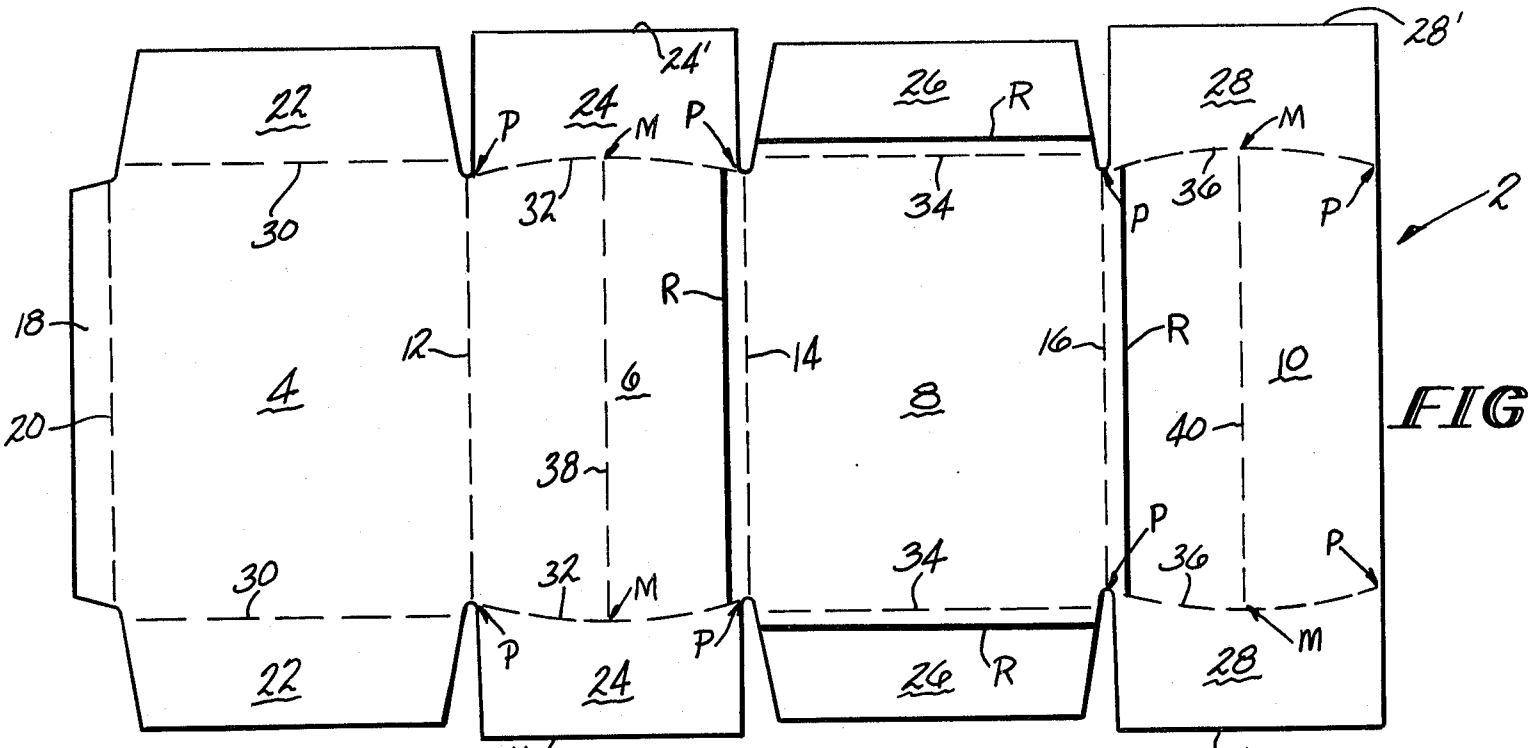
FIG. 1 is a plan view of a cut and scored corrugated paperboard blank from which a preferred embodiment of a shipping carton formed in accordance with this invention is formed.

Referring now to the drawings, there is shown in FIG. 1 a preferred embodiment of a cut and scored corrugated paperboard blank, denoted generally by the numeral 2, from which a preferred embodiment of a shipping carton formed in accordance with this invention can be erected. The blank 2 includes a plurality of side wall panels 4, 6, 8 and 10 connected together in series by parallel fold lines 12, 14 and 16. A glue flap 18 is connected to the side wall panel 4 by a fold line 20. Pairs of end closure flaps 22, 24, 26 and 28 are connected to the side wall panels 4, 6, 8 and 10 respectively by fold lines 30, 32, 34 and 36. The fold lines 32 and 36 are curved so that their mid portions M are closer to the free edges 24' and 28' of the end closure flaps 24 and 28 respectively than their end portions P are. Thus the fold lines 32 and 36 are curved toward the free edges of their respective end closure flaps 24 and 28. The fold lines 30 and 34 are positioned so that they are even with the mid points M of the fold lines 32 and 36. Each side panel 6 and 10 is provided with a medial fold line 38 and 40 respectively which extend across the side wall panels 6 and 10 between the mid points M of the fold lines 32 and 36 respectively. Reference lines R are printed on the side wall panels 6 and 10 and on the end closure flaps 26 closely adjacent to the fold lines 14, 16 and 34.

Figure 2:
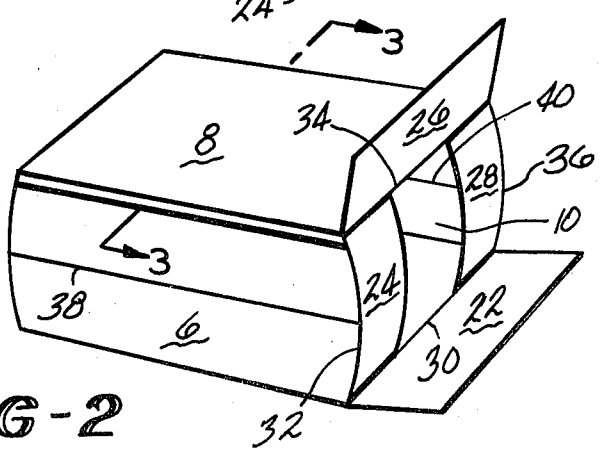
FIG. 2 is a perspective view of the erected carton formed from the blank of FIG. 1 with one set of the end closure flaps thereof being shown partially open.

Referring now to FIG. 2, the erected shipping carton formed from the blank 2 is shown. The side wall panels are folded about their respective fold lines and the glue flap is glued in place to form the generally tubular carton as shown in FIG. 2. The end closures are formed by first folding the end closure flaps 24 and 28 inwardly about the curved fold lines 32 and 36 respectively to the position shown in FIG. 2. It will be understood that at this point the inner cartons will be disposed in the shipping carton, but for purposes of clarity, the inner cartons are not shown in FIG. 2. The infolding of the end closure flaps 24 and 28 about the curved fold lines 32 and 36 causes the side walls 6 and 10 to bow inwardly along the fold lines 38 and 40 respectively, and also causes the opposed free side edges of the closure flaps 24 and 28 to deflect inwardly.

To complete the end closure, the end closure flaps 22 and 26 are then folded inwardly about the fold lines 30 and 34 and glued onto the closure flaps 24 and 28. Thus, the closure flaps 24 and 28 are the inner end closure flaps, and the closure flaps 22 and 26 are the outer end closure flaps.

Figure 3:
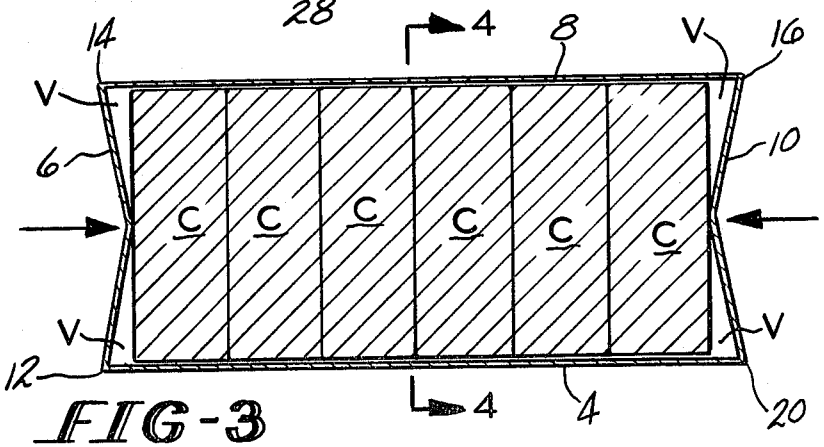
FIG. 3 is a sectional view taken along line 3—3 of FIG. 2 showing the inward medial bowing of the side walls of the carton and how this spaces the contained cartons from the side edges of the bowed side walls.

Referring now to FIG. 3, the manner in which the inner product-containing cartons C are kept away from the folded corners 12, 14, 16 and 20 by the bowed side walls 6 and 10 as shown. It is noted that inwardly of each of the corners 12, 14, 16 and 20 there is formed a free space or void V inside the shipping carton. Thus a knife used to cut open the shipping carton along any of the corners 12, 14, 16 or 20 will not touch any of the inner cartons C. The reference lines R which are shown in FIG. 1 are printed in registry with the void V and thus provide an indication as to where the carton is to be cut.

Figure 4:
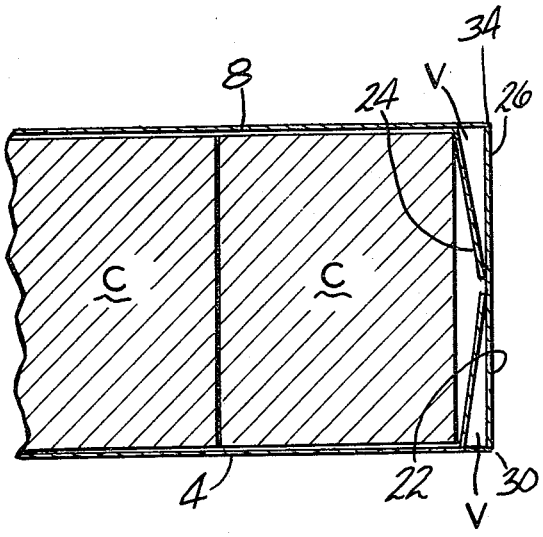
FIG. 4 is a fragmented sectional view of the closed carton as viewed along line 4—4 of FIG. 3 and showing the bowed end closure flaps and how they serve to displace the contained cartons from the end closure of the shipping carton.

Referring now to FIG. 4, the bowing of the inner end closure flaps 24 is shown. It will be noted that the edges of the bowed inner end closure flaps 24 engage the inner cartons C and hold them away from the outer end closure flaps 22 and 26. Thus the inner void V is continued inwardly adjacent to the corner fold lines 30 and 34. The reference line R is also in registry with this void.

Figure 5:
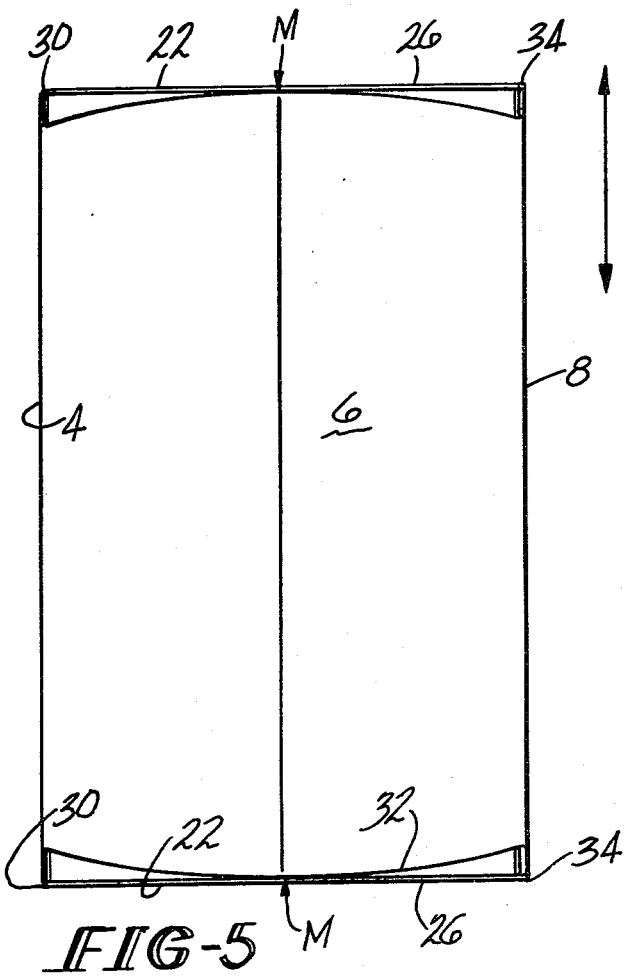
FIG. 5 is a side elevation view of the shipping carton as seen looking at the bowed side wall and showing how the outer end closure flaps provide a flat stacking surface for the carton.

Referring to FIG. 5, it can be seen how the outer end closure flaps 22 and 26 combine to form flat end stacking surfaces whereby the shipping cartons can be stacked end on end atop each other. This flat surface is produced by aligning the fold lines 30 and 34 with the mid point M of the curved fold lines 32, as previously noted.

Figure 6:
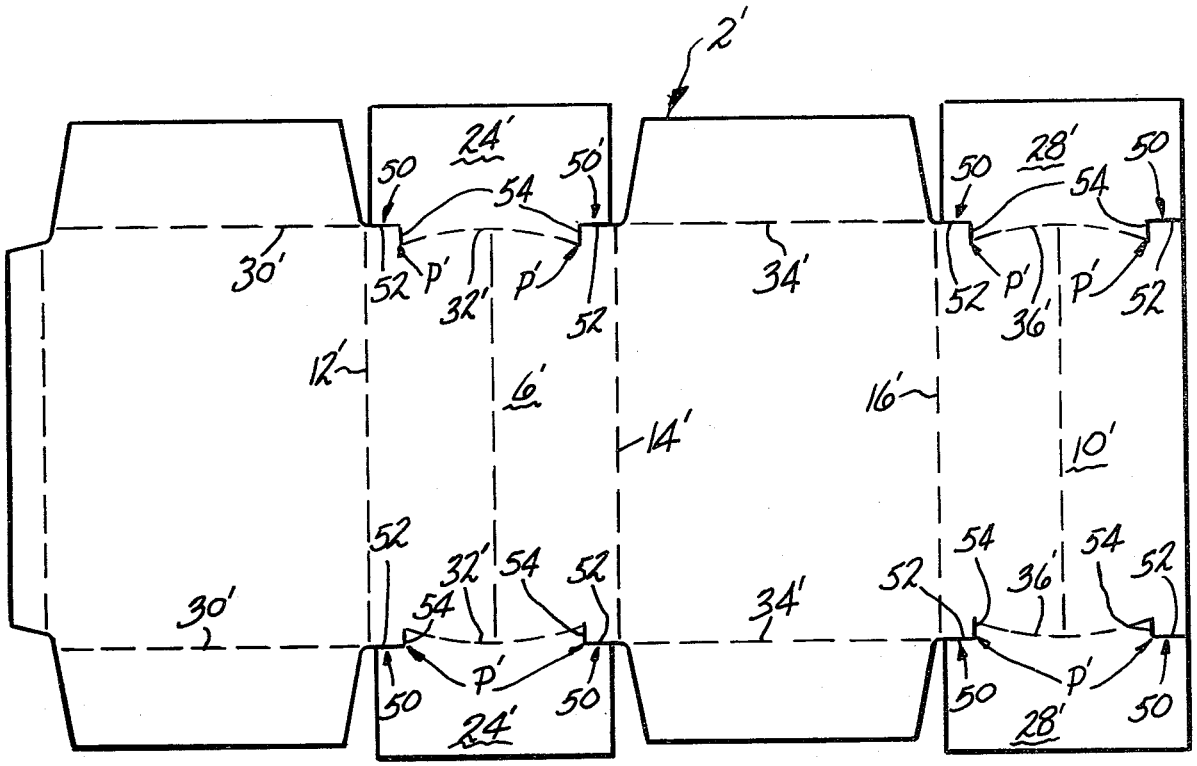
FIG. 6 is a plan view of a second embodiment of a blank from which a modified shipping carton is formed in accordance with this invention.
Figure 7:
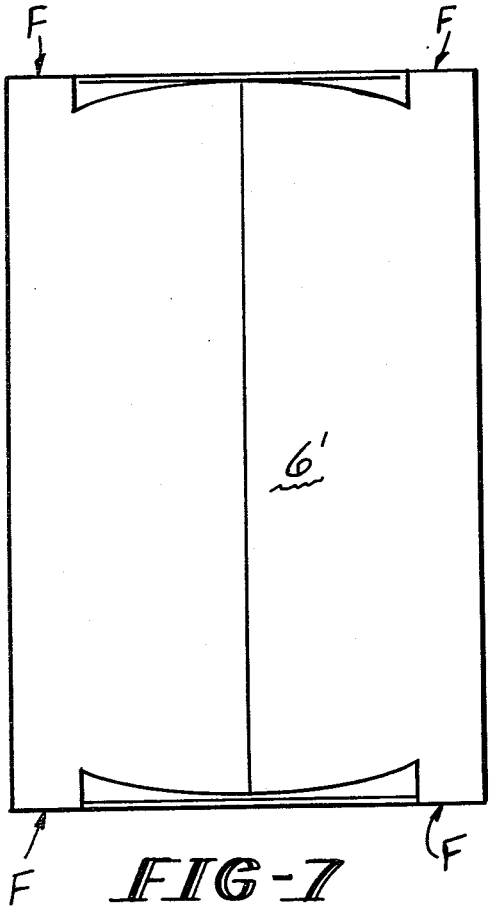
FIG. 7 is a side elevational view of the shipping carton formed from the blank of FIG. 6.

Referring now to FIG. 6, there is shown a modified embodiment of the blank 2, wherein the same numerals will be used to indicate equivalent structure as were used in FIG. 1. It will be noted that the blank 2' of FIG. 6 is generally similar to the blank 2 of FIG. 1 except that the curved fold lines 32' and 36' are shorter in the blank of FIG. 6, i.e., they do not extend all the way to the corner fold lines 12', 14' and 16' of the side wall panels 6' and 10'. In the blank of FIG. 6, there are provided a pair of stepped cuts 50 at each end of the curved fold lines 32' and 36' which have first portions 52 which are colinear with the fold lines 30' and 34', and second portions 54 perpendicular to the first portions 52, which second portions 54 extend to the end portions P' of the curved fold lines 32' and 36'. Referring to FIG. 7, it will be seen that the stepped cuts 50 form corner stacking feet F on both ends of the erected shipping carton. These feet F provide increased stacking strength for the erected cartons.

Figure 8:
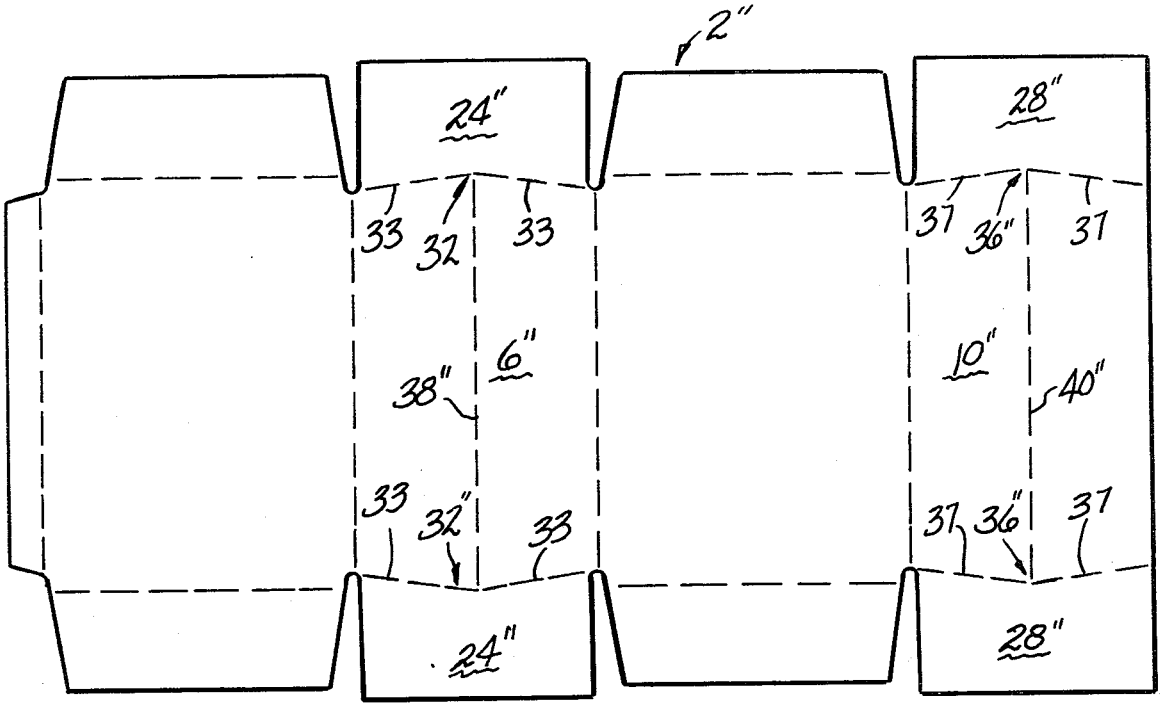
FIG. 8 is a plan view of yet another embodiment of a blank for forming a shipping carton in accordance with this invention.
Figure 9:
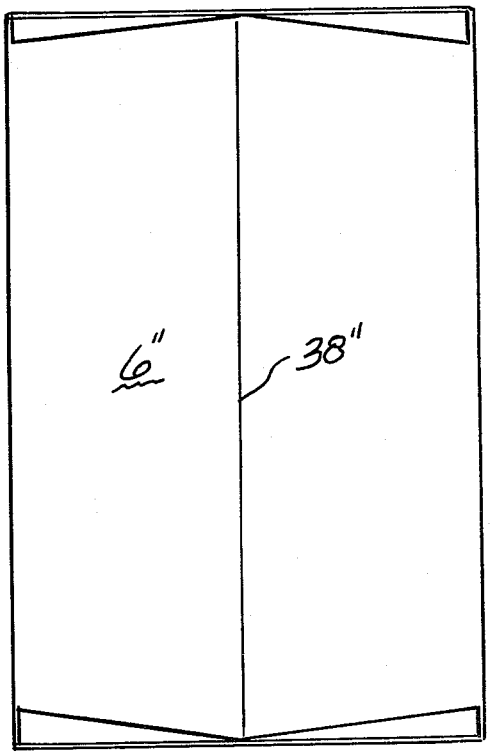
FIG. 9 is a side elevational view of the erected carton formed from the blank of FIG. 8.

Referring now to FIGS. 8 and 9, there is shown another modified form of the invention wherein the blank 2'' is substantially identical to the blank 2 of FIG. 1 except that the fold lines 32'' and 36'', rather than being curved, are formed by two straight skewed components 33 and 37 respectively. When the inner end closure flaps 24'' and 28'' are folded in, the same bowing of the side walls 6'' and 10'' will occur along the medial fold lines 38'' and 40'' as will the bowing of the inner end closure flaps 24'' and 28'', as shown in FIG. 9, with the same overall result as previously described.

Figure 10:
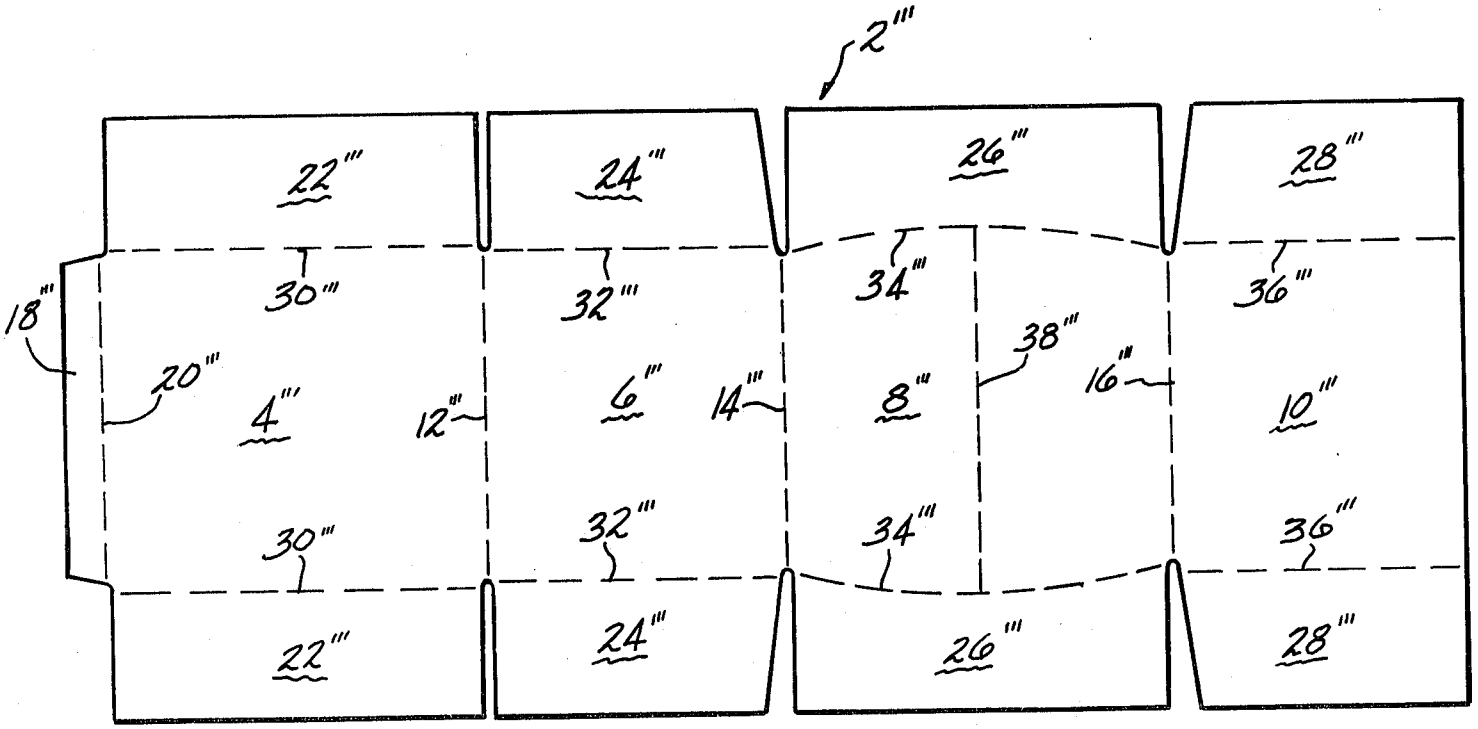
FIG. 10 is a plan view of still another embodiment of a blank for forming a shipping carton in accordance with this invention.
Figure 11:
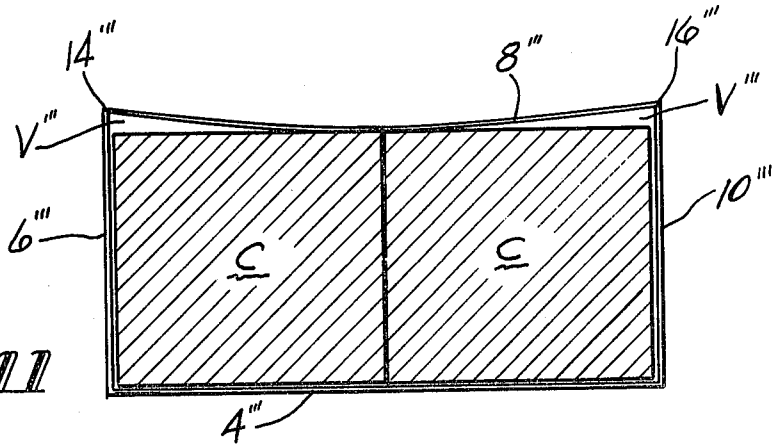
FIG. 11 is a cross-sectional view of the carton erected from the blank of FIG. 10 showing the manner in which the bowed side wall operates to create an internal void at the edges of the carton.

Referring now to FIGS. 10 and 11, a fourth embodiment of the invention is shown wherein the blank 2''', includes a plurality of side wall panels 4''', 6''', 8''' and 10''' connected in series by fold lines 12''', 14''' and 16'''. A glue flap 18''' is connected to the side wall panel 4''' by a fold line 20'''. End closure flaps 22''', 24''', 26''' and 28''' are connected to side wall panels 4''', 6''', 8''' and 10''' by fold lines 30''', 32''' and 36''' respectively. It will be noted that only the fold lines 34''' are curved, and the remaining end closure flap fold lines are straight. A medial fold line 38''' extends across the side wall panel 8''' between the curved fold lines 34'''. Thus when the carton is erected, only the side wall 8''' will bow inwardly, as seen in FIG. 11. Thus the internal voids V''' are formed inwardly adjacent to the corners 14''' and 16'''.

It will be readily appreciated that the shipping carton of this invention is of simple construction and yet reliably provides for internal clearance for a knife blade used to cut the carton open, whereby damage to the cartons contained in the shipping carton is avoided. By connecting internal end closure flaps to side walls with bowed fold lines, both the side walls and end closure flaps will bow in such a manner as to ensure knife blade clearance. As used in this context, a bowed fold line is intended to mean either a curved fold line or a compound skewed straight fold line, as specifically disclosed herein. The bowing of this side wall is accentuated by a medial fold line formed in the side wall which is bowed.

Since many changes and variations of the disclosed embodiments of the invention may be made without departing from the inventive concept, it is not intended to limit the invention otherwise than as required by the appended claims.

What is claimed is:

1. A package comprising in combination a corrugated paperboard shipping carton containing a plurality of product cartons, said shipping carton comprising:

(a) a series of side walls connected together along corner fold lines to form a tubular container;

(b) pairs of inner end closure flaps foldably connected to opposite ends of a first opposed pair of said side walls;

(c) pairs of outer end closure flaps overlapping said inner end closure flaps and foldably connected to opposite ends of a second opposed pair of said side walls along straight fold lines;

(d) said inner end closure flaps each being connected to each of said first opposed pair of side walls along bowed fold lines with a medial portion of each bowed fold line being closer to an outer free edge of the respective inner end closure flap than end portions of said bowed fold line;

(e) a medial fold line on each of one of said first opposed pair of side walls extending between said medial portions of said bowed fold lines; and (f) each of said first opposed pair of side walls being bowed inwardly of said container along said medial fold lines, and each of said inner end closure flaps being bowed outwardly of said container whereby side edges of said inner end closure flaps are inwardly offset from said straight fold lines when said end closure flaps are folded to a container-closing position said bowing of said first opposed pair of side walls and said inner end closure flaps being operable to offset said product cartons disposed in said container from the corner fold lines defining side edges of said first opposed pair of side walls and from said straight fold lines wherein the container can be cut proximate the corner fold lines and proximate said straight fold lines without risking damage to said product cartons.

2. The package of claim 1 wherein said outer end closure flaps are connected to said second opposed pair of side walls along straight fold lines which are substantially in alignment with said medial portions of said bowed fold lines to provide substantially flat outer end surfaces on said carton for stacking purposes.

3. The package of claim 2, further comprising a plurality of cuts extending from opposite ends of said bowed fold lines to adjacent corner fold lines of said container to provide stacking feet on said carton which are coplanar with said straight fold lines.

4. The package of claim 1 wherein said bowed fold lines are curved.

5. The package of claim 1 wherein said bowed fold lines consist of a pair of skew straight fold lines.

6. A corrugated paperboard shipping carton comprising:

(a) a series of four side walls connected together along corner fold lines to form a tubular container;

(b) pairs of inner end closure flaps foldably connected to opposite ends of a first opposed pair of said side walls;

(c) pairs of outer end closure flaps foldably connected to opposite ends of a second opposed pair of said side walls to overlie said inner end closure flaps;

(d) said inner end closure flaps each being connected to each of said first opposed pair of side walls along bowed fold lines with a medial portion of each bowed fold line being closer to an outer free edge of the respective inner end closure flap than end portions of said bowed fold line;

(e) said outer end closure flaps being connected to said second opposed pair of side walls along straight fold lines which are substantially colinear with said medial portions of said bowed fold lines;

(f) a medial fold line on each of said first opposed pair of side walls extending between said medial portions of said bowed fold lines;

(g) each of said first opposed pair of side walls being bowed inwardly of said container along said medial fold lines, and each of said inner end closure flaps being bowed outwardly of said container whereby side edges of said inner end closure flaps are inwardly offset from said straight fold lines when said inner and outer end closure flaps are folded to a carton closing position; and (h) means forming reference lines extending across said first opposed pair of side walls closely adjacent to the corner fold lines interconnecting said first and second opposed pairs of side walls with each other, and said reference lines further extending across said outer end closure flaps closely adjacent to said straight fold lines, said reference lines being operable to provide a visual indication of where said shipping carton can be cut open without damaging product cartons disposed inside of said shipping carton.

* * * * *